US006893367B1

(12) United States Patent
Nudo

(10) Patent No.: US 6,893,367 B1
(45) Date of Patent: May 17, 2005

(54) HOCKEY PUCK WITH AERODYNAMIC PINS

(76) Inventor: Patrick R. Nudo, 1520 Lake shore Dr., Springfield, IL (US) 62707

( * ) Notice: Subject to any disclaimer, the term of this patent is extended or adjusted under 35 U.S.C. 154(b) by 0 days.

(21) Appl. No.: 10/459,493

(22) Filed: Jun. 12, 2003

(51) Int. Cl.[7] ..... A63B 71/02
(52) U.S. Cl. ..... 473/588
(58) Field of Search ..... 473/588, 589

(56) References Cited

U.S. PATENT DOCUMENTS

| | | | | |
|---|---|---|---|---|
| 2,444,810 | A | 7/1948 | Creasy | |
| 2,727,744 | A * | 12/1955 | Watson | 473/588 |
| 3,090,109 | A | 5/1963 | White et al. | |
| 3,784,204 | A | 1/1974 | Felber | |
| 4,111,419 | A * | 9/1978 | Pellegrino | 473/425 |
| 4,793,769 | A | 12/1988 | Dolan | |
| 4,801,144 | A | 1/1989 | Masi et al. | |
| 5,184,820 | A * | 2/1993 | Keating et al. | 473/588 |
| 5,275,410 | A | 1/1994 | Bellehumeur et al. | |
| 5,362,045 | A | 11/1994 | Hammett et al. | |
| 5,518,238 | A | 5/1996 | Hu et al. | |
| 5,697,858 | A | 12/1997 | Lekavich | |
| 5,928,096 | A * | 7/1999 | Boardman et al. | 473/588 |
| 6,010,418 | A | 1/2000 | Lekavich | |
| 6,126,561 | A | 10/2000 | Mark | |
| 6,139,438 | A | 10/2000 | Park et al. | |
| 6,248,034 | B1 | 6/2001 | Voloshen | |
| 6,277,042 | B1 | 8/2001 | Lekavich | |
| 6,328,664 | B1 | 12/2001 | Hammett | |
| 6,440,018 | B2 | 8/2002 | Lekavich | |

* cited by examiner

*Primary Examiner*—Raleigh W. Chiu

(57) ABSTRACT

A hockey puck having aerodynamic pins located on each surface is provided for play on synthetic ice. The pins utilize dish shaped heads which provide substantially frictionless movement for the puck. The pins in one surface are mounted in offset relationship compared to the pin heads mounted in the opposing surface. Each pin is held in the puck by an interference fit making the pins easy to replace.

9 Claims, 2 Drawing Sheets

HOCKEY PUCK WITH AERODYNAMIC PINS

BACKGROUND OF THE INVENTION

The present invention relates to the field of hockey practice devices and more specifically to the field of hockey pucks. Hockey pucks are traditionally made of rubber and have two flat surfaces. Hockey pucks for use on surfaces, other than ice, have rollers or pins which permit the puck to glide on the surface.

Hockey pucks which include rollers are disclosed in the patents to Creasy U.S. Pat. No. 2,444,810, White U.S. Pat. No. 3,090,109, Felber U.S. Pat. No. 3,784,204 and De Masi, Jr. et al. U.S. Pat. No. 4,801,144. These pucks include balls or rollers. Dolan U.S. Pat. No. 4,793,769 discloses a plurality of ball bearings imbedded in a puck. The balls, bearings or rollers permit the users to advance the puck along the street or on pavement.

Plastic pucks made with pins are also used on cement or asphalt. These pucks are molded with interlocking pins or the puck is molded separately and the pins are inserted through each end of the hole formed during the molding process and the pins are joined by locking the fasteners together. The pins are made with heads which form bearing surfaces. Unfortunately, the pins often break off causing the user to either replace the pins or dispose of the entire puck. Moreover, with the limitations provided by traffic laws and trespassing, this type of street or playground hockey is no longer a popular game.

Synthetic ice offers a user the advantage of playing hockey at home in the basement or on the driveway or outside on any flat surface. There is a need in the industry of a hockey puck for use on synthetic ice. The currently used pucks have failed to meet the needs of the industry by providing lightweight pucks having pins which can be used without breaking during play.

SUMMARY OF THE INVENTION

The present invention is directed to a hockey puck having a conventional rubber body and aerodynamic pins which include heads which extend beyond each surface the puck. The puck is designed for use on synthetic ice made of high density polyethylene. The pin heads positioned on one surface are offset compared to the pin heads positioned on the opposing surface. Each pin has a stem which is held in the puck by an interference fit making the pins easy to replace.

It is an object of the present invention to provide a method of making a conventional hockey puck designed for use on synthetic ice.

It is another object of the present invention to provide a rubber hockey puck having bearing surfaces designed for sliding on synthetic ice.

It is still another object of the present invention to provide a rubber hockey puck having replaceable bearings.

Another object of the present invention is to provide a pin having an aerodynamic head used for play on synthetic ice.

The present invention overcomes the problems pending with the prior art by providing an inexpensive conventional hockey puck for use on synthetic ice. The hockey puck has aerodynamic bearings located on each surface of the puck. The pins heads mounted on one surface are offset in relationship to the pin heads mounted on the opposing surface. Each pin is held in the puck by an interference fit making the pins easy to replace.

DETAILED DESCRIPTION OF THE DRAWINGS

DESCRIPTION OF THE PREFERRED EMBODIMENTS

Figure 1:
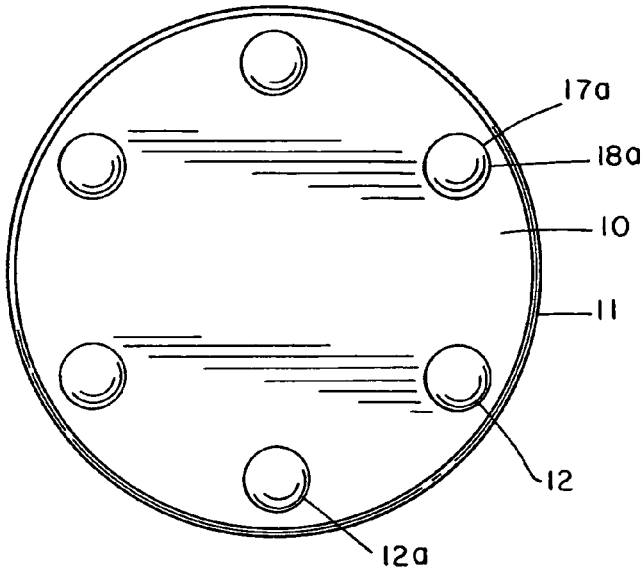
FIG. 1 is a top plan view of a synthetic ice hockey puck of the present invention.
Figure 2:
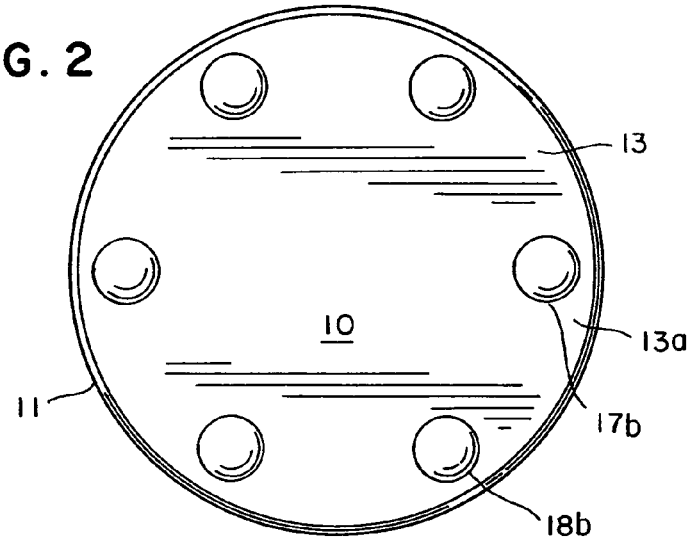
FIG. 2 is a bottom plan view of the synthetic ice hockey puck of the present invention.
Figure 3:
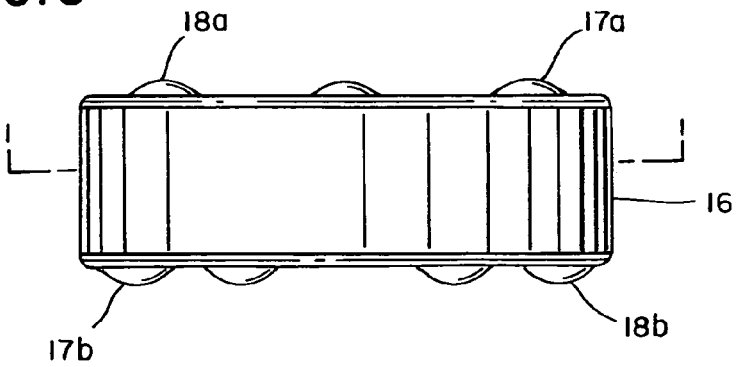
FIG. 3 is a side elevational view of the synthetic ice hockey puck of the present invention.

A conventional rubber hockey puck designed for use on synthetic ice is depicted in FIGS. 1–3. Synthetic ice is well known and is made of high molecular weight polyethylene such as a 5100 series high molecular weight polyethylene sold by General Electric. The surface of the synthetic ice provides a frictionless playing surface for the hockey puck of the present invention.

As shown in FIGS. 1–3, a hockey puck 10 for use on synthetic ice is illustrated. The puck 10 has a body 11 made of rubber. The type of rubber and size is identical to well known hockey pucks for use on ice.

The puck 10 includes two surfaces 12, 13, which will be referred to as a top face 12*a* and a bottom face 13*a* for purposes of understanding this invention. Obviously, during play the puck 10, turns over frequently and during play neither face is referred to top or bottom. Projecting above each surface is a plurality of pins 17*a*, 17*b* which serve as a bearing surface for the puck as it slides on the synthetic ice. Each pin 17*a*, 17*b* has a head 18*a*, 18*b* which forms a bearing surface 18*c* and a stem 19 as shown in FIG. 4.

Figure 4:
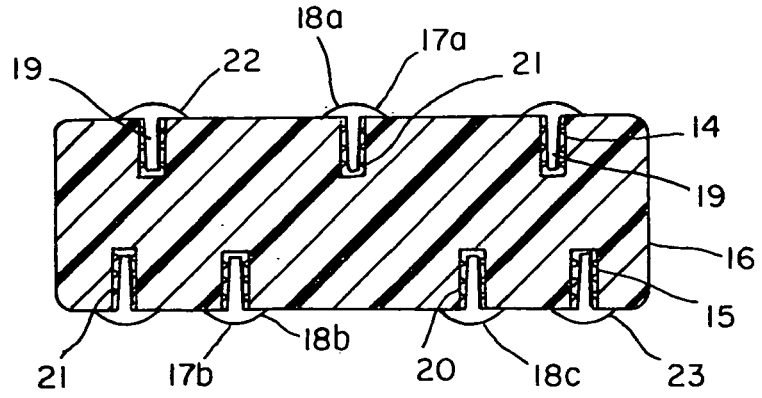
FIG. 4 is a cross sectional view of the present invention taken along lines 1—1 of FIG. 3.
Figure 5:
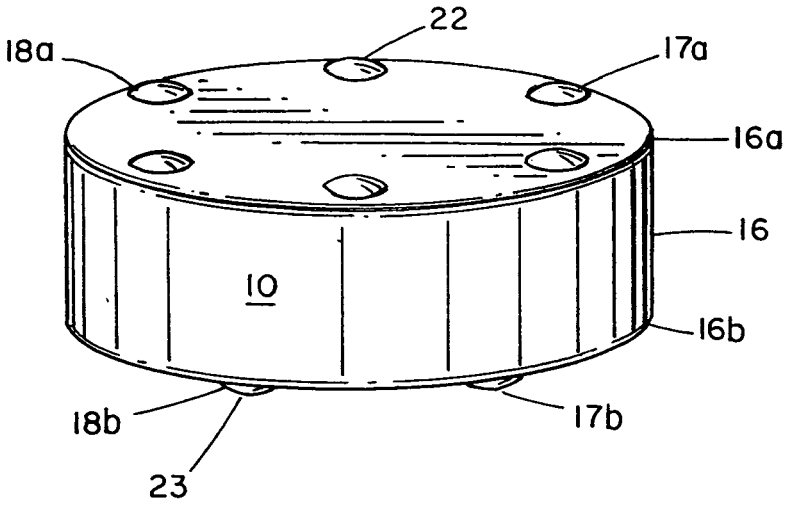
FIG. 5 is a front perspective view of the synthetic ice hockey puck of the present invention.

Turning now to FIG. 4, the process of making the puck will now be described. In order to provide a frictionless surface for play on synthetic ice, holes 14 and 15 have drilled into the puck from each surface 12*a* and 13*a*. The holes 14, 15 formed in the top surface 12 are offset from the holes on the bottom surface 13. The body 11 of the puck 10 also has and side wall 16 which is substantially flat and a top ridge 16*a* and a bottom ridge 16*b*.

As shown in FIG. 4, a cross sectional view of lines 1—1 of FIG. 3 depicts a plurality of holes 14 and 15 which have been drilled into each face 12*a*, 13*a* of the puck 10 and into the puck body. Each hole 14, 15 have a diameter of approximately one eighth of an inch and a depth of approximately three quarters of an inch. A wall 20 is formed in each hole and flanges or ribs 21 are formed in the walls of each hole. The flanges or ribs 21 are the intended result of using a knurled bit during drilling of each hole. The flanges 21 are used to provide an interference fit and assist in securing the stem 19 of each pin 17 inside the hole against the wall. The ribs made be coated with oil before the pins are inserted to make the pins easier to remove.

Again referring to FIG. 4, the pins 17*a*, 17*b* may be further secured in the holes 14, 15 by adhesive. During the manufacturing process, the holes are filled with enough adhesive to secure each pin without overflow onto either surface of the puck. The adhesive flows between the flanges 20 of the hole 14, 15 to lock the pins 17*a*, 17*b* to the wall 20 in the hole. The locking force provided by the adhesive and the flanges prevents the pin from breaking during play.

As illustrated in all the drawings and forming part of the present invention, the pins 17*a* mounted in the top face 12*a* are offset to the pins 17*b* mounted in the bottom face. Accordingly, the top heads 22 which extend from the surface 12*a* are offset from the bottom heads 23 which extend from the surface 13*a*. The heads 22, 23 projecting from each surface are mounted offsetting relationship to enable the use of the puck despite the loss of one bearing surface 18*c*. Moreover, as a pin 17*a* rides on the surface 12 of the synthetic ice there is no direct contact with the pin 17*b* mounted indirectly below in the opposite surface 13. Accordingly, and unlike prior art pucks, any contact on the pins mounted in the top surface 12 does not directly affect the pins riding on the synthetic ice. As the user of the puck may contact the pins 17*a* projecting from the top surface with a hockey stick, the pins 17*b* on the bottom surface are not directly pounded into the synthetic ice.

Figure 6:
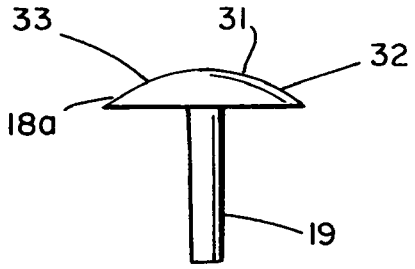
FIG. 6 is a front perspective view of a pin used in the synthetic ice hockey puck of the present invention.

Turing now to FIG. 6, an aerodynamic pin of the present invention is illustrated and will be described, acknowledging that pin heads 18*a* and 18*b* are identical. Each pin 17*a*, 17*b* is made of high density polyethylene material by injection molding. The pin heads 18*a*, 18*b* are formed with a round bearing portion 31 having a dish portion 32 which forms an acute angle relative to the ice surface of 20 degrees or less during contact. The dish portion of each pin forms substantially frictionless contact points 33 for the puck on the ice without cutting or chafing the head.

The stem of the pin 19 is approximately one half inch in length and has a rough surface to provide a locking contact surface for the adhesive. In the preferred embodiment, each head has a height of less than one eighth of an inch and never more than a quarter of an inch. By providing a limited height on the head of each pin, the pins are less likely to break while the puck more resembles the puck used without pins as used in ice hockey. Moreover, the user is less likely to break the pins with his stick by using shorter projecting pins.

In any of the embodiment described above, the pins may be made with florescent material for decorative purposes of to assist the user during play at dark. The formation of the pins provide the puck with a longer life than pucks of the prior art. The aerodynamic heads further increase the speed of the puck and the fun of the game.

What is claimed is:

1. A rubber hockey puck in combination with an aerodynamic pin comprising;

a puck body made of hard rubber, said puck body having a top surface, a bottom surface, and a plurality of holes formed in said top face and into said puck body and in said bottom face and partially into said puck body, each hole formed in said top face offset from each holes formed in said bottom face;

said holes form walls having ribs which assist in securing said stem in said puck a plurality of aerodynamically shaped pins, each pin including a stem mounted into a hole in said puck body.

2. A hockey puck, said puck made of hard rubber, said puck body having a top surface and a bottom surface, in combination with an aerodynamic pin comprising;

a plurality of aerodynamically shaped pins, each pin mounted a hole formed in the surfaces of said puck by an interference fit, each pin including;

a stem extending into a hole;

a head having a dish shaped surface having an acute angle of 20 degrees or less relative to the plane of said surfaces of said puck; and, said puck body having a plurality of holes formed in said top face and said bottom face, each hole formed in said top face offset from each hole formed in said bottom face, each hole having a diameter smaller than said diameter of said pin stem, said holes form walls having ribs which assist in securing said stem in said puck.

3. The hockey puck according to claim 2, wherein said pin is composed of high density polyethylene plastic.

4. The hockey puck according to claim 2, wherein said dish shaped surface forms a bearing surface.

5. The hockey puck according to claim 2, wherein said ribs are coated with oil.

6. A hockey puck in combination with an aerodynamic pin comprising; a puck body, said puck body made of hard rubber, said body having a top surface, a bottom surface, and a plurality of holes formed in said top face and said bottom face, each hole formed in said top face offset from each holes formed in said bottom face said holes form walls having ribs which assist in securing said stem in said puck, and, a plurality of aerodynamically shaped pins, each pin mounted and secured in said hole by an interference fit.

7. The hockey puck according to claim 6, wherein said pin is composed of high density polyethylene plastic.

8. The hockey puck according to claim 6, wherein said pin has a head with a dish shaped surface which forms a bearing surface.

9. The hockey puck according to claim 6, wherein said ribs are coated with oil.

* * * * *